US006393748B1

(12) United States Patent
Cooper

(10) Patent No.: US 6,393,748 B1
(45) Date of Patent: May 28, 2002

(54) SIGN SUPPORT SYSTEM

(76) Inventor: Jonathan Cooper, 500 east 76th St., Suite 2RN, New York, NY (US) 10021

( * ) Notice: Subject to any disclaimer, the term of this patent is extended or adjusted under 35 U.S.C. 154(b) by 0 days.

(21) Appl. No.: 09/571,375

(22) Filed: May 15, 2000

Related U.S. Application Data

(60) Provisional application No. 60/139,155, filed on Jun. 14, 1999.

(51) Int. Cl.[7] ..... G09F 7/18

(52) U.S. Cl. ..... 40/610; 40/611; 248/464; 248/165

(58) Field of Search ..... 40/607, 606, 611, 40/610, 618, 603, 605, 124.05; 248/166, 163.1, 168, 172, 164, 431, 432, 165, 436, 176.1, 150, 472; 211/198, 199, 189, 195

(56) References Cited

U.S. PATENT DOCUMENTS 2,902,239 A * 9/1959 Janecka, Jr.
3,969,838 A * 7/1976 Moore
4,005,537 A * 2/1977 Von Camber et al.

* cited by examiner

*Primary Examiner*—Douglas C. Butler
(74) *Attorney, Agent, or Firm*—Michael Zall

(57) ABSTRACT

The system includes a plurality of parallel vertically disposed end support structures. Each support structure comprises two vertically disposed support legs. The upper and lower ends of the support legs are connected respectively to each other by upper and lower connecting members that can be extended or collapsed. When the connecting members are both extended the support structure forms a frame support structure and when collapsed, the support legs are in close proximity and parallel to each other, suitable for storage and/or transport. Channel members are removably mounted to the upper and lower ends of the support legs to connect the end support structures to each other when the connecting members of the support legs are extended. A sign panel is mounted between the upper and lower channel members. Optionally, the sign support system has vertically disposed parallel end support members removably mounted to the upper ends of the vertically disposed support legs. A top channel member is provided connecting and removably mounted to the upper ends of the support members. An upper sign panel is removably mounted between the top channel and the opposing upper channel member.

11 Claims, 15 Drawing Sheets

SIGN SUPPORT SYSTEM

RELATED APPLICATIONS

This application is related to Provisional Application Serial No. 60/139,155 filed on Jun. 14, 1999 entitled Sign Slide System. The entire disclosure of this provisional application is incorporated herein by reference.

BACKGROUND OF THE INVENTION

1. Field of the Invention

The present invention relates to a sign support system for use at, for example, athletic games, track and field events, road races, and marathons. The sign support system provides a stable, easily assembled and disassembled multi-unit sign installation that may be expanded horizontally and vertically.

2. Prior Art

Numerous sign stands, poster display devices, structures for exhibitions, for use, for example, at trade shows, conventions, athletic events, indoor races, marathons, etc, are known for holding and displaying signs for providing advertisement and other information to the public. Generally, they comprise a plurality of upright support members between which a number of panels are mounted for easy assembly or disassembly by means of screws or equivalent fastening means. As there are many such events and shows in different places, it is highly advantageous that these structures be easily and inexpensively be broken down, shipped from one place to another and reassembled into a structure suitable for the venue. Generally, when these structures are shipped in unassembled form, the bulk or volume occupied by the various component parts is considerably larger than desired, difficult to pack and often incur unnecessarily high shipping charges. Additionally, the required layout of signage in one venue may be completely different than the previous one, requiring a higher, shorter, and/or longer signage layout.

Still further, sign and stand apparatuses designed for outdoor use must be sturdy to withstand the wind and elements. Typically the known stands are positioned on supports or posts that are anchored in the ground, held in place by sandbags or other heavy objects, or spring-mounted on bases which allow them bend or deflect without tipping over under high wind forces. Although such sign stand units are well known, it is still desirable to provide a light, portable and wind-resistant sign and stand apparatus which employs a minimum number of parts or components, has a unique and attractive appearance, is inexpensive to manufacture, and may be used in many different applications, including point-of-purchase displays, pedestrian or vehicular traffic messages or barriers, commercial advertisements for athletic games, track and field events, road races, and marathons, and the like, etc.

Several prior art references that relate to sign holders are:

U.S. Pat. No. 5,029,378 to Stocker describes an apparatus for attaching a sign element to a base with a frameless magnetically attractive support system.

U.S. Pat. No. 4,698,928 to Soporowski describes a sign holder used to display prices and to advertise special sales. This sign holder assembly may be mounted to elevated wires, easel supports, or shelf brackets and reduces the number of sign parts the store owner is required to keep on hand. The holder is rectangularly-shaped and has slots adapted to be slidably mounted on various supports.

U.S. Pat. No. 4,642,926 to Friedman describes a knock-down exhibition panel assembly for use at exhibits. The system comprises a panel system of flanged members with thumb screws and latching mechanisms to join a plurality of members. The system includes a plurality of upright rigid supporting members with generally planar members releasably connected on opposite sides to two adjacent supporting members. Each panel has an intermediate portion and along the two opposed edges are respective flange portions extending in opposite directions from the intermediate portion. This panel configuration enables the panels to be stacked in nesting fashion.

U.S. Pat. No. 4,641,448 to Cobb describes a post sign having a message panel supported by one or more posts. Each post has an elongated channel connected to an outer side of the post by an elongated slot. The message panel is mounted on the post or posts by an interconnecting support member which fits in the channel, leaving exposed an upper terminal portion of the channel and slot. The open upper end of the support member is covered by a spacer cap, and the open upper end of the post is covered by a post cap having a tab which fits into the open terminal portion of the channel and slot in the post.

U.S. Pat. No. 4,516,344 to Seely describes a lightweight, portable, wind resistant sign and stand apparatus. The apparatus includes a plurality of ground-engaging legs secured to a longitudinally-extending elongated base assembly. The base assembly includes clamping members for clampingly anchoring a thin, flat sign panel protruding generally upwardly therefrom. The sheet material of which the sign panel is composed is sufficiently rigid that the sign panel is self-supporting in its protruding relationship with the base assembly. The sign panel is sufficiently flexible and resilient to bendably deflect in high winds, without yielding.

Other prior art references of interest are:

U.S. Pat. No. 67,347 to Reef, Jr. describes a scaffold and trestle support that can extend in length and height through the use of slidably interconnected horizontal and vertical members.

U.S. Pat. No. 5,402,860 to Fry describes a sawhorse comprised of rectangular metal tubes and "I" beams that are attached to and contained within a main beam. Side mounted tubes swing out and extend tubular members contained within them. "I" beams extend from the main beam and extend channel beams transverse to the longitudinal axis. Through a series of holes and pins the beam extensions and the supporting legs are adjustable over a wide range.

U.S. Pat. No. 5,437,425 to Hou describes a folding stand for an office chair stand that has an annular frame to hold the upright shaft of an office chair. A plurality of radial lugs are horizontally spaced around the annular frame and have a plurality of legs hinged to the radial lugs that are supported on a wheel assembly. The wheel assembly can be turned between a working position in line with the respective lug and a collapsed position perpendicular to the respective lug. A retainer spring is retained in each leg to lock the leg in the working position or the collapsed position.

U.S. Pat. No. 5,404,962 to Carter describes a collapsible support that includes a cross member and a pair of collapsible support brackets having pairs of generally tubular legs extending therefrom. Each support bracket includes a generally planar base member secured to the cross member and a pivotally attached leg carrier. The leg pairs are secured to the leg carrier and are pivotable therewith from extended load bearing positions to collapsed storage or transport positions. A spring lock mechanism is provided which engages a portion of the leg carrier in the extended load bearing position and secures it in a releasable attachment in the load bearing position.

U.S. Pat. No. 5,779,003 to Carty describes a collapsible sawhorse having rotatable leg sections for holding the legs and hinges to enable each pair of legs to collapse against the underside of the horizontal rail. The leg sections are outwardly angled to provide increased sawhorse stability. Tabs at the top of the leg sections insert into tab slots on the bottom of a hinged top plate for providing a stable sawhorse.

U.S. Pat. No. 5,836,365 to Derecktor describes a portable work bench that includes a track having a structural body, and four collapsible legs for supporting the track in an elevated position above a surface. The work bench further includes a dual purpose accessory releasably attachable to the track. The dual purpose accessory has a body, a rail member for slidably mounting the body on the track so that the body is movable along the length of the track, a locking member for locking the body at a desired position along the length of the track. An extension is also described for extending the overall length of the work bench.

OBJECTS AND SUMMARY OF THE INVENTION

A primary object of the sign support system of this invention is to secure signs to an associated stable base fixture which is easily assembled, and disassembled and when disassembled is relatively portable. The system may be used at sporting events, track meets, marathons, etc. and after use, disassembled and transported and used at another event.

A further object of this invention is to provide a sign support system that is easy to disassemble at one venue, pack, ship, unpack and reassemble in a another venue.

It is yet a another object of this invention to provide a sign support system that may be assembled to provide an almost unlimited length of signage by horizontally connecting a plurality of sign support units or modules.

It is yet a further object of this invention to provide a sign support system that may be assembled to provide flexibility in the height of signage by vertically connecting a plurality of units or modules.

All of the objects of this invention are achieved by the sign support system of this invention. Broadly, the system includes a plurality of substantially vertically disposed end support structures, the support structures being substantially parallel to each other. Each support structure comprises two substantially vertically disposed support legs, each leg having an upper and a lower end. The upper ends of the support legs are connected to each other by an upper connecting member that can be extended or collapsed. The lower ends of the support legs are also connected to each other by a lower connecting member that can be extended or collapsed. When the upper and lower connecting members are both extended the support structure forms a frame support structure, preferably an A-Frame type structure. When the upper and lower connecting members are both collapsed, the support legs are in close proximity and parallel to each other, suitable for storage and/or transport.

A first pair of upper channel members having opposing ends are provided. Each member has a channel therein. The opposing ends of the channel members each connect to and are removably mounted to the upper ends of the support legs to connect the first and second end support structures to each other when the upper and lower connecting members of the support legs are extended.

A second pair of lower channel members having opposing ends are provided. Each member has a channel therein. The opposing ends of the channel members each connect to and are removably mounted to the lower ends of the support legs to connect the first and second end support structures to each other when the upper and lower connecting members of the support legs are extended.

Each of the channels in the upper channel members are provided with a downwardly opening channel and each of the channels in the lower channel members are provided with an upwardly opening channel. At least one lower sign panel is provided of a size, shape and thickness suitable for removably mounting between the opposing lower and upper channel members in the opposing downwardly and upwardly opening channels, e.g. it is slid between the channel members.

Optionally, the sign support system comprises first and second substantially vertically disposed and parallel end support members. Each end support member has a lower end and an upper end, the lower end of the first support member being removably mounted to the upper end of the vertically disposed support leg of the first end support structure and the lower end of second support member being removably mounted to the upper end of the vertically disposed support leg of the second end support structure. A top channel member is provided having opposing ends and a downwardly opening channel, the opposing ends of the top channel member connecting and removably mounted to the upper ends of the first and second end support members to connect the first and second end support members to each other. An upper sign panel of a size, shape and thickness suitable for removably mounting between the top channel and the opposing upper channel member in the downwardly opening channel is provided.

DETAILED DESCRIPTION OF THE INVENTION

Figure 1:
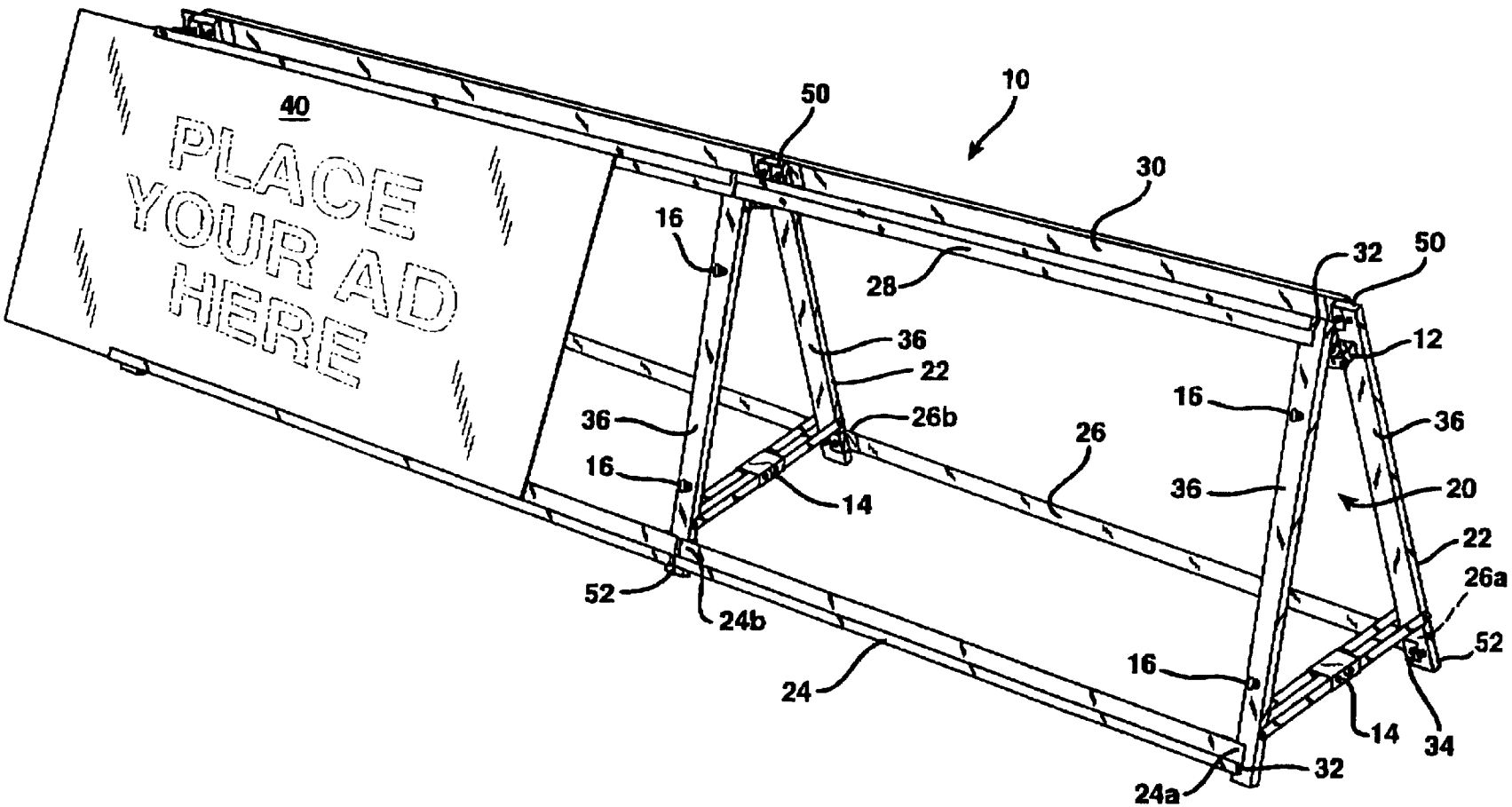
FIG. 1 is a perspective view of an embodiment of an assembled horizontal multi-unit sign support system with a sign being placed therein.
Figure 2:
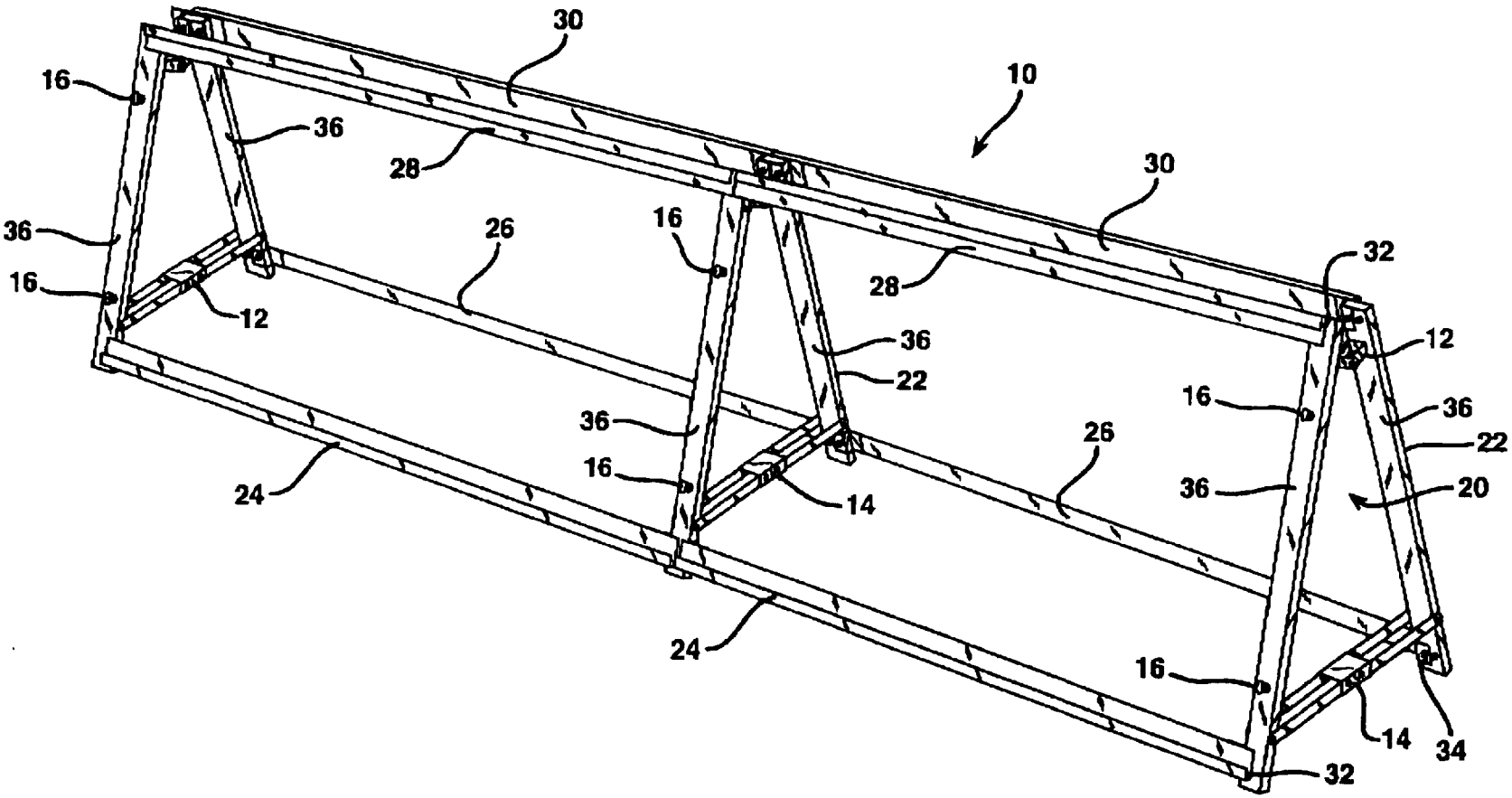
FIG. 2 is a perspective view of an embodiment of an assembled horizontal multi-unit sign support system without a sign therein.

Referring to FIGS. 1–10, wherein like reference characters designate like or corresponding parts throughout the views, the system 10 comprises a metal frame unit 20 and a sign panel 40. Referring, for example, to FIG. 1, which is a perspective view of an embodiment of an assembled horizontal multi-unit sign support system 10 with a sign 40 being placed therein. A plurality of substantially vertically disposed end support structures 22 are provided. The support structures 22 are substantially parallel to each other. Each support structure 22 includes two substantially vertically disposed support legs 36. Each leg 36 has an upper 50 and a lower end 52. The upper ends 52 are connected to each other by an upper connecting member 12 that can be extended or collapsed. The lower ends 52 are connected to each other by a lower connecting member 14 that can be extended or collapsed. When the upper and the lower connecting members 12, 14 are both extended, as depicted in FIGS. 1, 2, and 6 the support structure 48 forms a frame support structure. Preferably, the support structure 48 formed is an A-Frame type support structure, although other types are contemplated by this invention. When the upper and lower connecting members 12, 14 are both collapsed or folded, the support legs 36 are in close proximity and parallel to each other for easy storage and transportation.

Referring to FIGS. 6 A & B, which are perspective views of the preferred embodiment of the A-frame support 22 used in the sign support system 10 of this invention, the connecting members 12 and 14 of each A-frame 22 work on a hinge system, a top hinge system 11 on the top of A-Frame 22 and a lower hinge system 13 on the bottom of A-Frame 22. The connecting members 12 and 14 of each A-frame 22 can be collapsed or folded pushing each of the hinges 11, 13 up and the frame legs 36 together.

Figure 3:
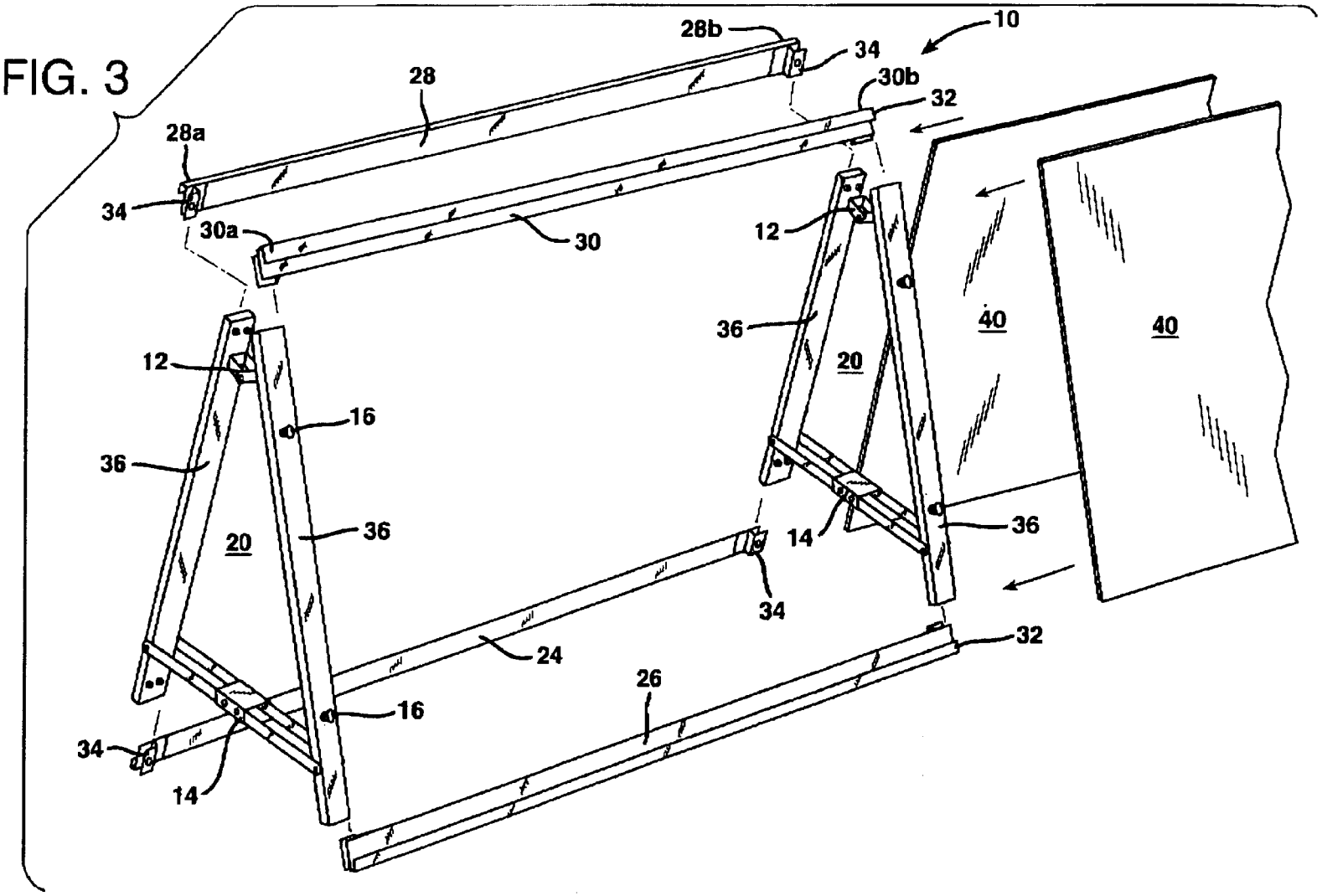
FIG. 3 is an exploded perspective view of an embodiment of a single unit sign support system schematically depicting the assembly thereof
Figure 4A:
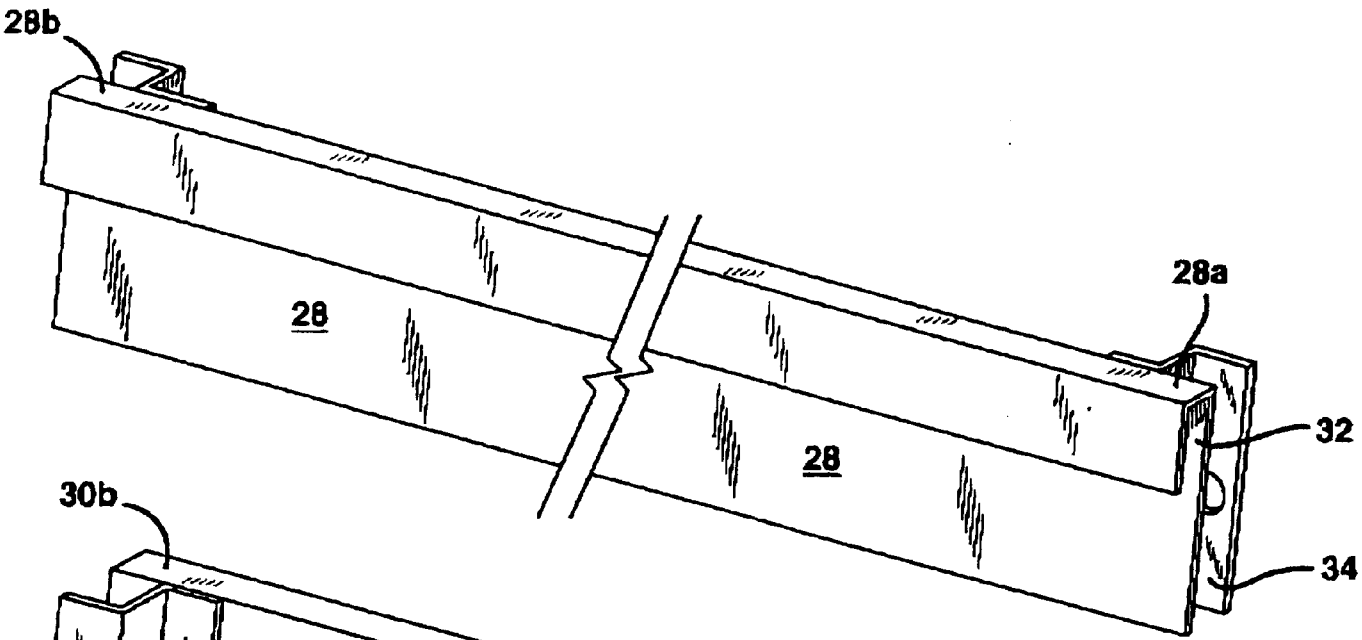
FIGS. 4A and 4B are perspective views of an embodiment of the upper and lower channel members, respectively, used for holding the sign and the brackets associated therewith for holding the members to the associated A-frame supports.
Figure 4B:
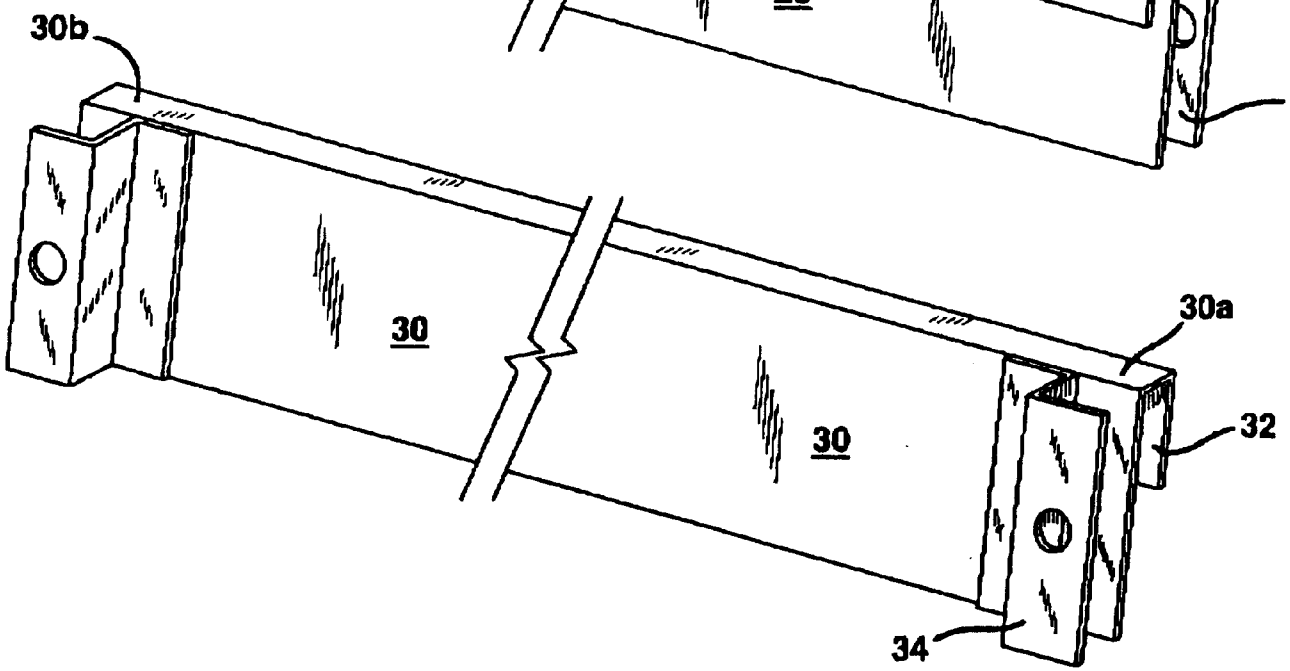

Referring to FIGS. 1–5, and particularly FIGS. 3 and 4, a first pair of upper channel members 28, 30 are provided. Each of these channel members 28, 30 have opposing ends 28*a*, 28*b*, and 30*a*, 30*b*. Each member 28, 30 has a channel 32 therein. Referring to FIGS. 3,4 and 5, the opposing ends of the channel member 28*a*, 28*b*, and 30*a*, 30*b* are connected and removably mounted to the upper ends 50 of the support legs 36 to connect the first and second end support structures 20 to each other when the upper and lower connecting members 12, 14 are extended.

Still referring to FIGS. 1–5, a second pair of lower channel members 24, 26 are provided having opposing ends 24*a*, 24*b* and 26*a*, 26*b*. Each member 24, 26 has a channel 32 therein. The opposing ends of the channel members 24*a*, 24*b* and 26*a*, 26*b* connect and are removably mounted to the lower ends 52 of the support legs 36 to connect the first and second end support structures 20 to each other when the upper and lower connecting members 12,14 are extended.

Referring, for example, to FIGS. 1 and 3, the channels 32 in the upper channel members 28, 30 have a downwardly opening channel 32 and the channels in the lower channel members 24, 26 have an upwardly opening channel 32. There is at least one lower sign panel 40 of a size, shape and thickness suitable for removably mounting between opposing lower 24, 26 and upper 28, 30 channel members in the opposing downwardly and upwardly opening channels 32. Preferably, this sign panel 40 slides between the opposing lower 24, 26 and upper 28, 30 channel members within the opposing downwardly and upwardly opening channels 32.

Figure 5B:
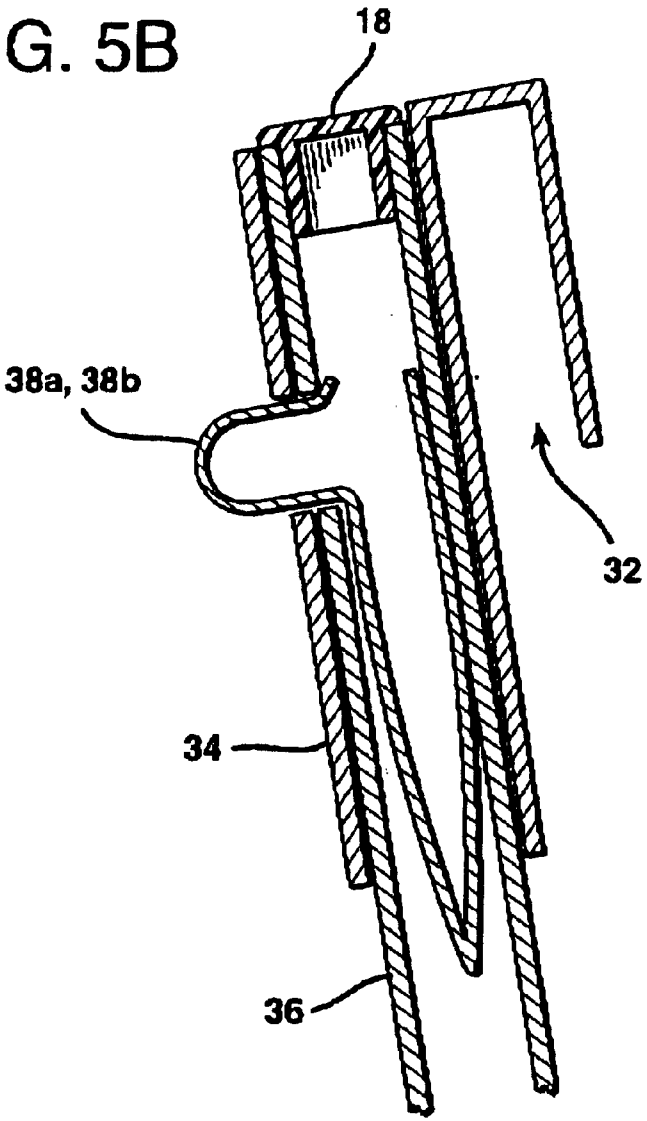
FIG. 5B is a cross-sectional view of the embodiment of FIG. 5A depicting the assembly of the elements required for mounting the end of an elongated channel member to an A-frame leg.
Figure 5A:
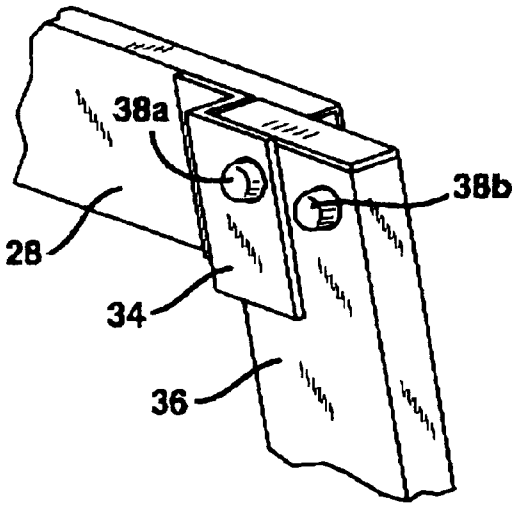
FIG. 5A is a perspective view depicting an embodiment of the assembly of the elements required for mounting the end of an elongated channel member to an A-frame leg.
Figure 5C:
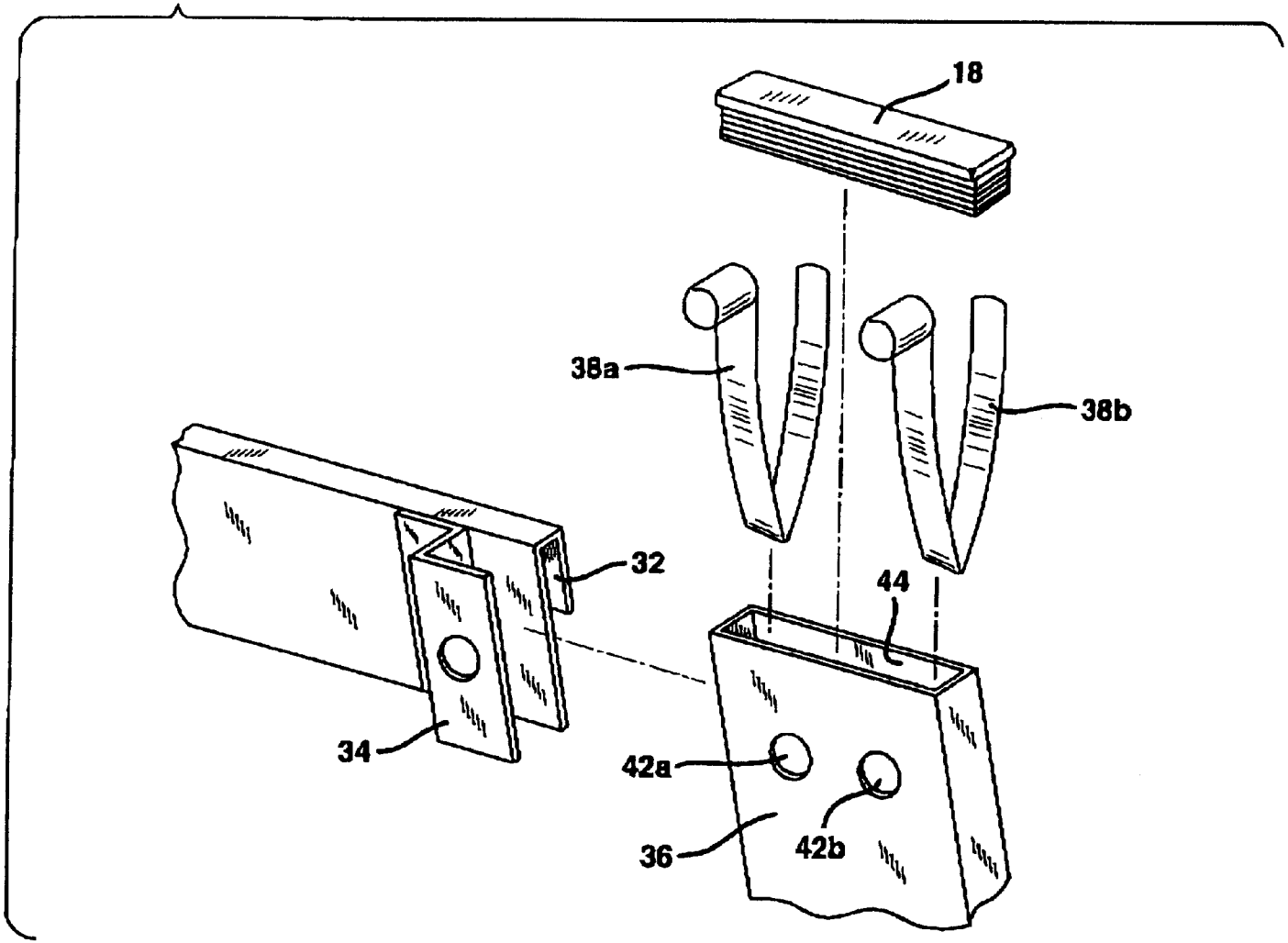
FIG. 5C is an exploded perspective view of the embodiment of FIG. 5A and FIG. 5B depicting the assembly of the elements required for mounting the end of an elongated channel member to an A-frame leg.
Figure 6A:
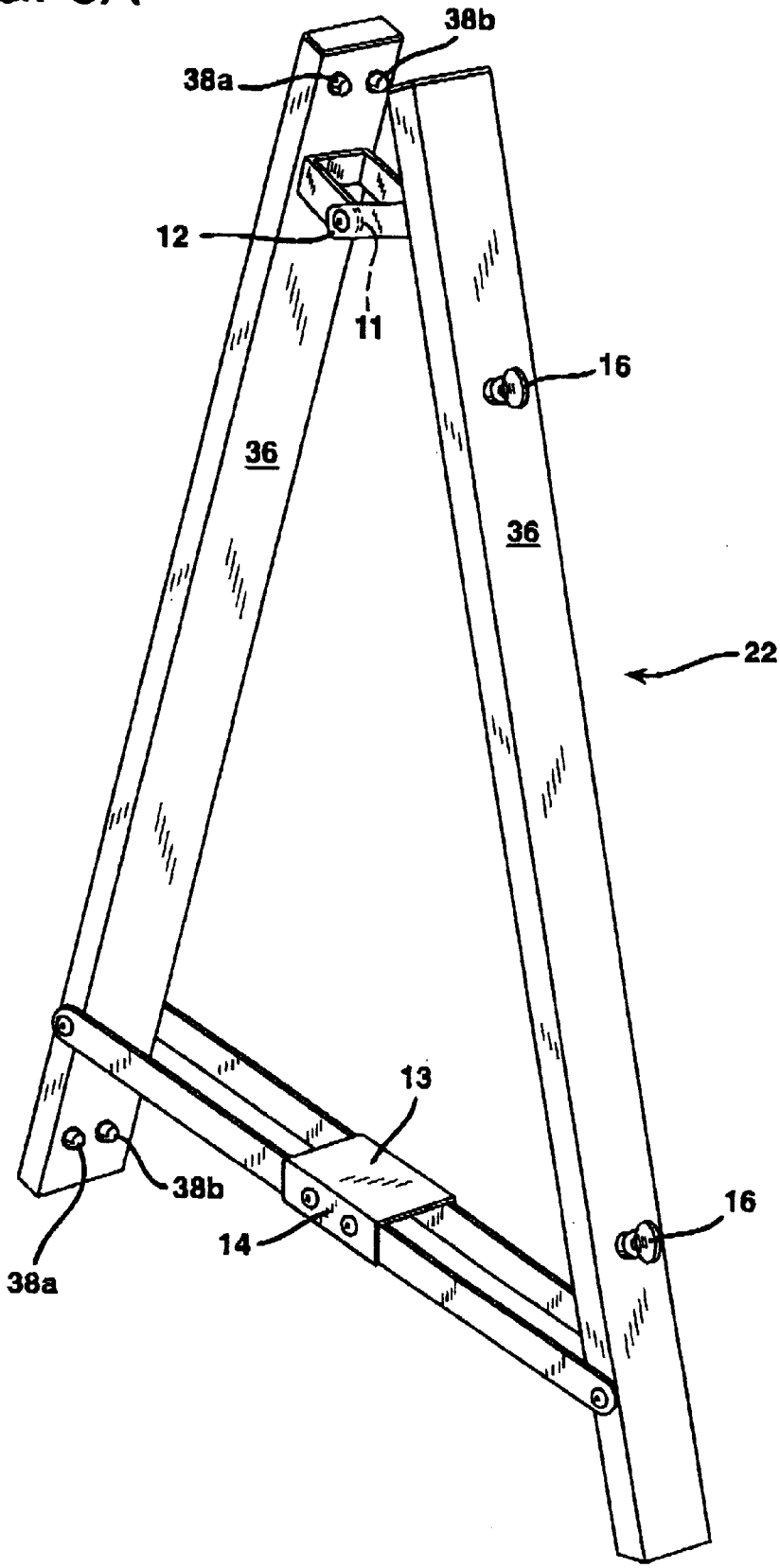
FIGS. 6A and 6B are perspective views of an embodiment of an A-frame support used in the sign support system of this invention.
Figure 6B:
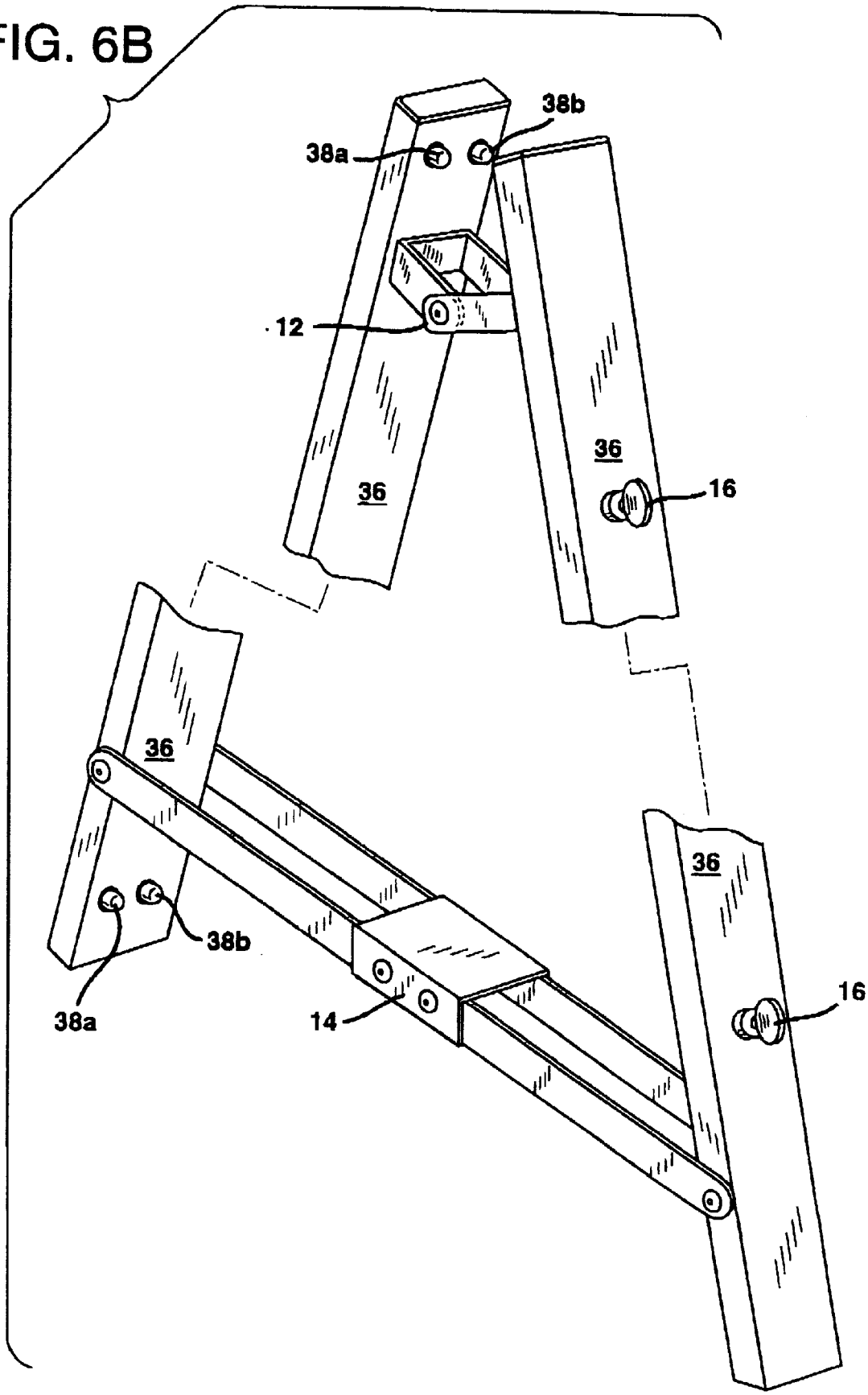

Referring to FIGS. 5A–5C, each channel member, for example upper channel members 28 and 30 depicted in these Figures, includes a channel or fluting 32 therein which is of a size that permits the sign panel 40 (see FIGS. 1 and 3) to slide therethrough and to removably hold the sign 40 in position. Each end of each channel 28*a*, 28*b*, and 30*a*, 30*b* has a bracket 34 mounted thereon. The bracket 34 is of a size and shape that permits the upper end 50 of leg 36 of A-frame 22 to slip into the bracket 34. This enables the channel member 28 to be removably mounted to the A-frame 22. A means is provided for locking the A-Frame leg 36 in the bracket 34. For example, as shown in detail in FIGS. 5A, B and C, spring clips 38*a* and 38*b*, are inserted into a formed hollow 44 in leg 36. A cap 18 is then fitted onto the end of leg 36 to maintain the clips 38*a* and 38*b* in place and to close of the end of hollow 44 in leg 36. The cap 18 also protects the end of leg 36, for example, when it is placed on the ground. When the A-frame leg 36 is inserted in the bracket 34 the portion of the clip 38*a* protruding through the holes 42*a* of leg 36 interlocks with a mating hole 46 in the bracket 34.

Figure 7A:
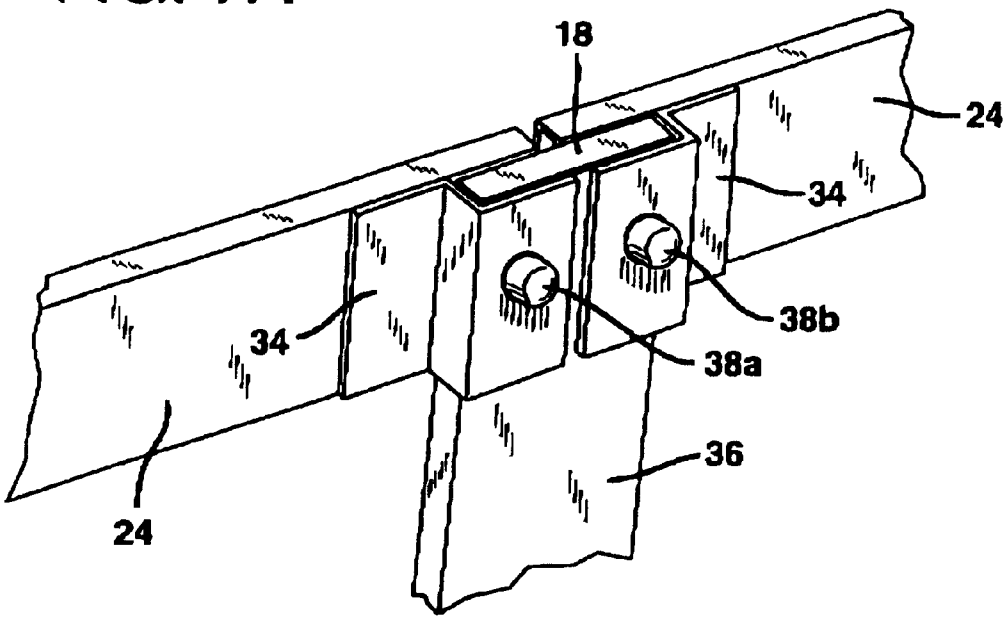
FIG. 7A is a rear perspective view of a portion the mating section of two sign support system units that form a horizontal multi-unit system depicting the assembly of the elements required for mounting the end of the elongated channel members to the common A-frame leg.
Figure 7B:
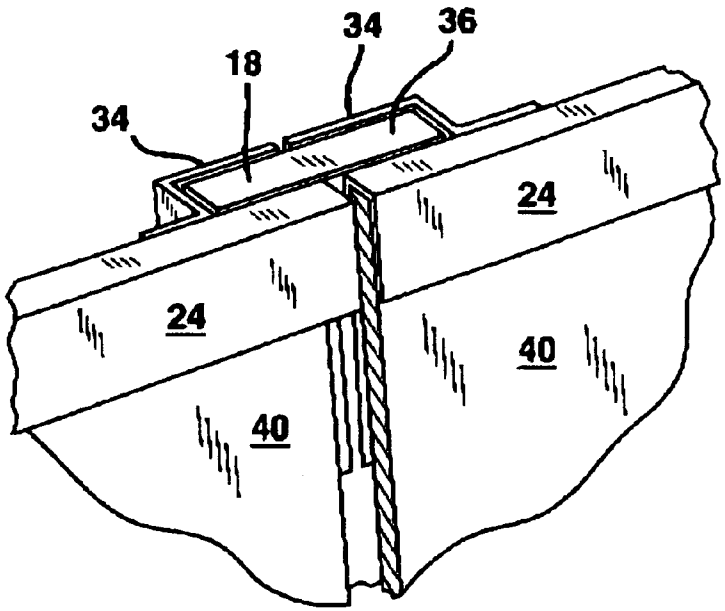
FIG. 7B is a front perspective view of a portion the mating section of two sign support system units that form a horizontal multi-unit system depicting the assembly of the elements required for mounting the end of the elongated channel members to the common A-frame leg.
Figure 8:
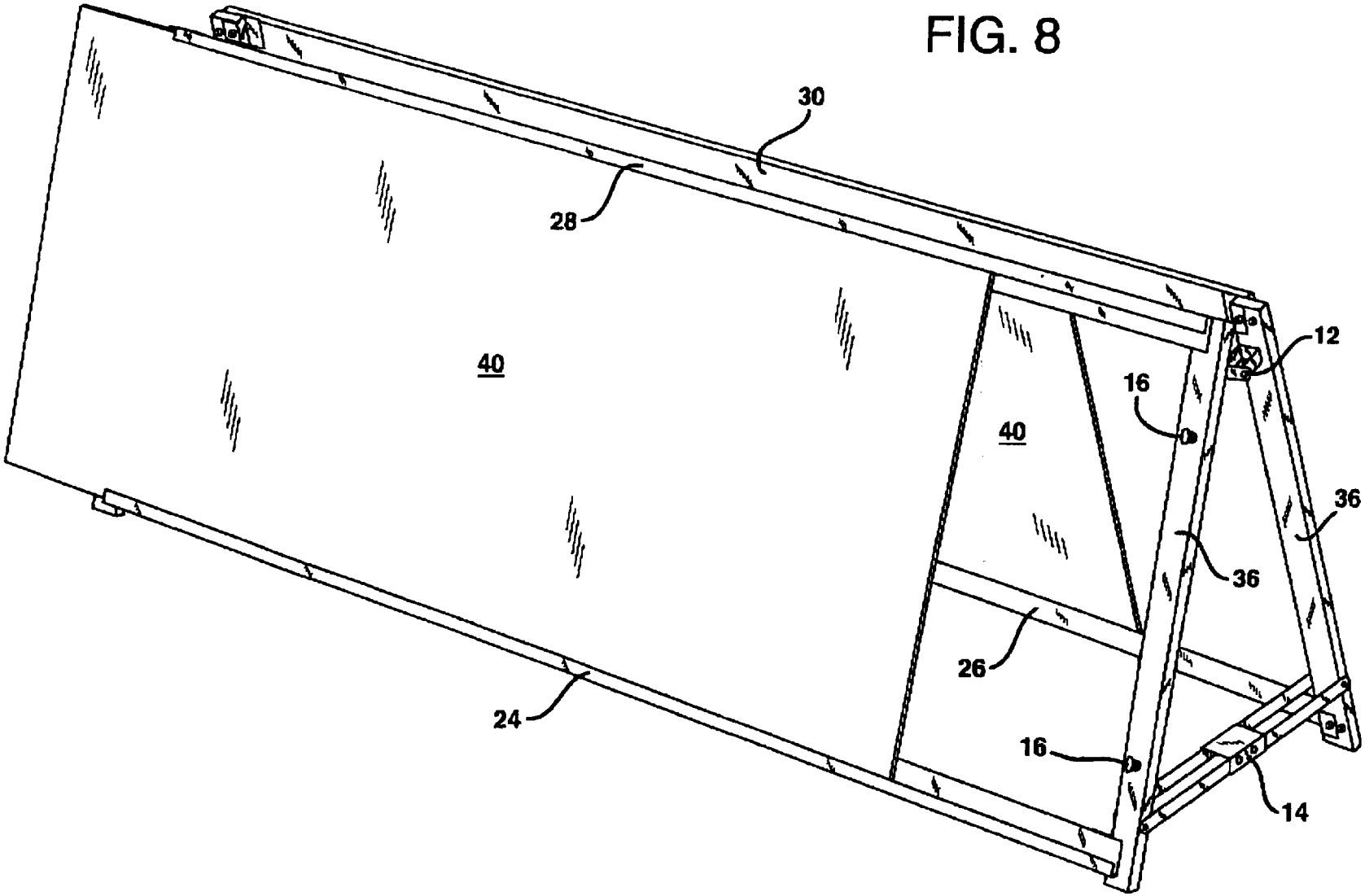
FIG. 8 is a perspective view of an embodiment of an assembled single unit sign support system with a sign being placed therein
Figure 9:
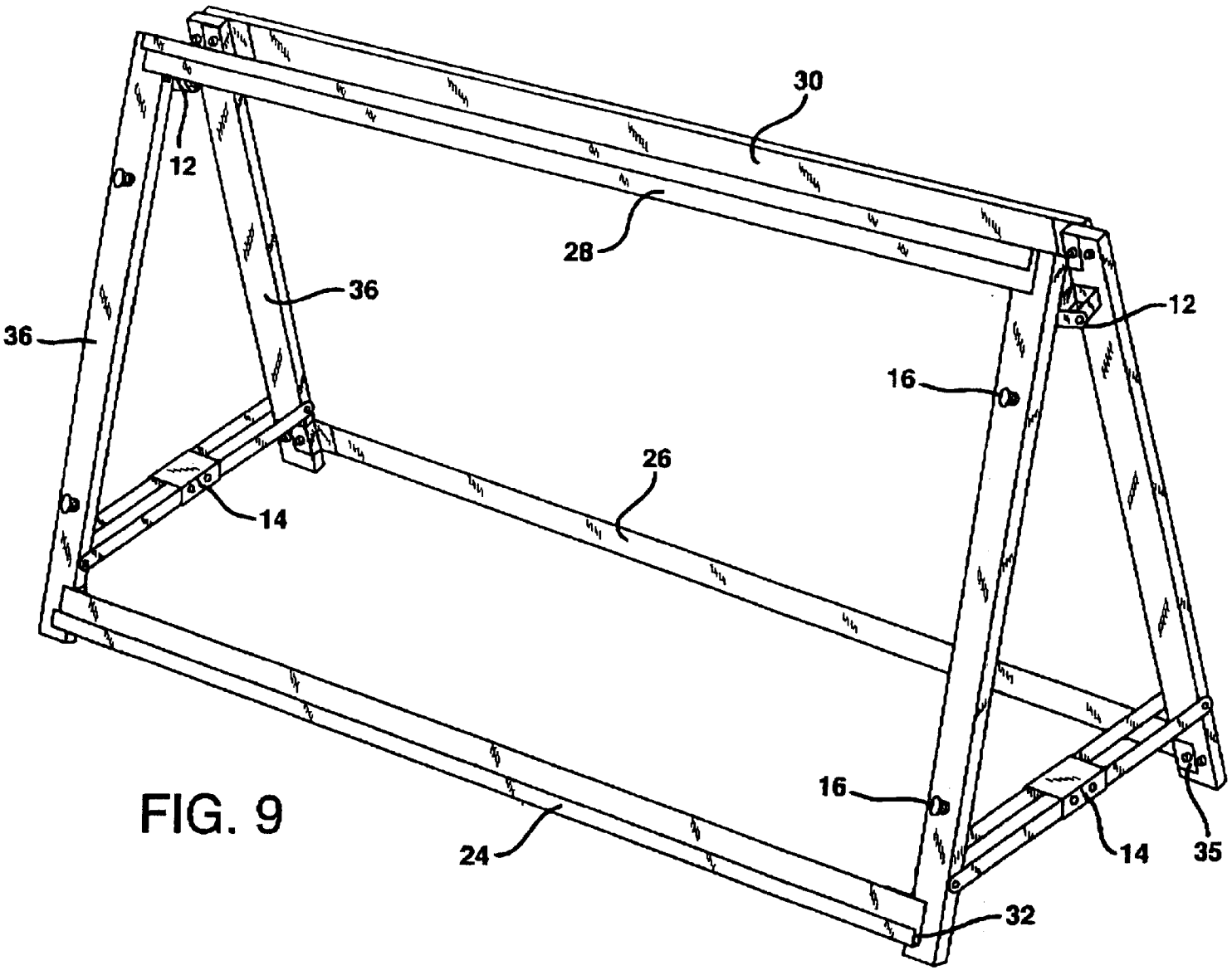
FIG. 9 is a perspective view of an embodiment of an assembled single unit sign support system without a sign.
Figure 10:
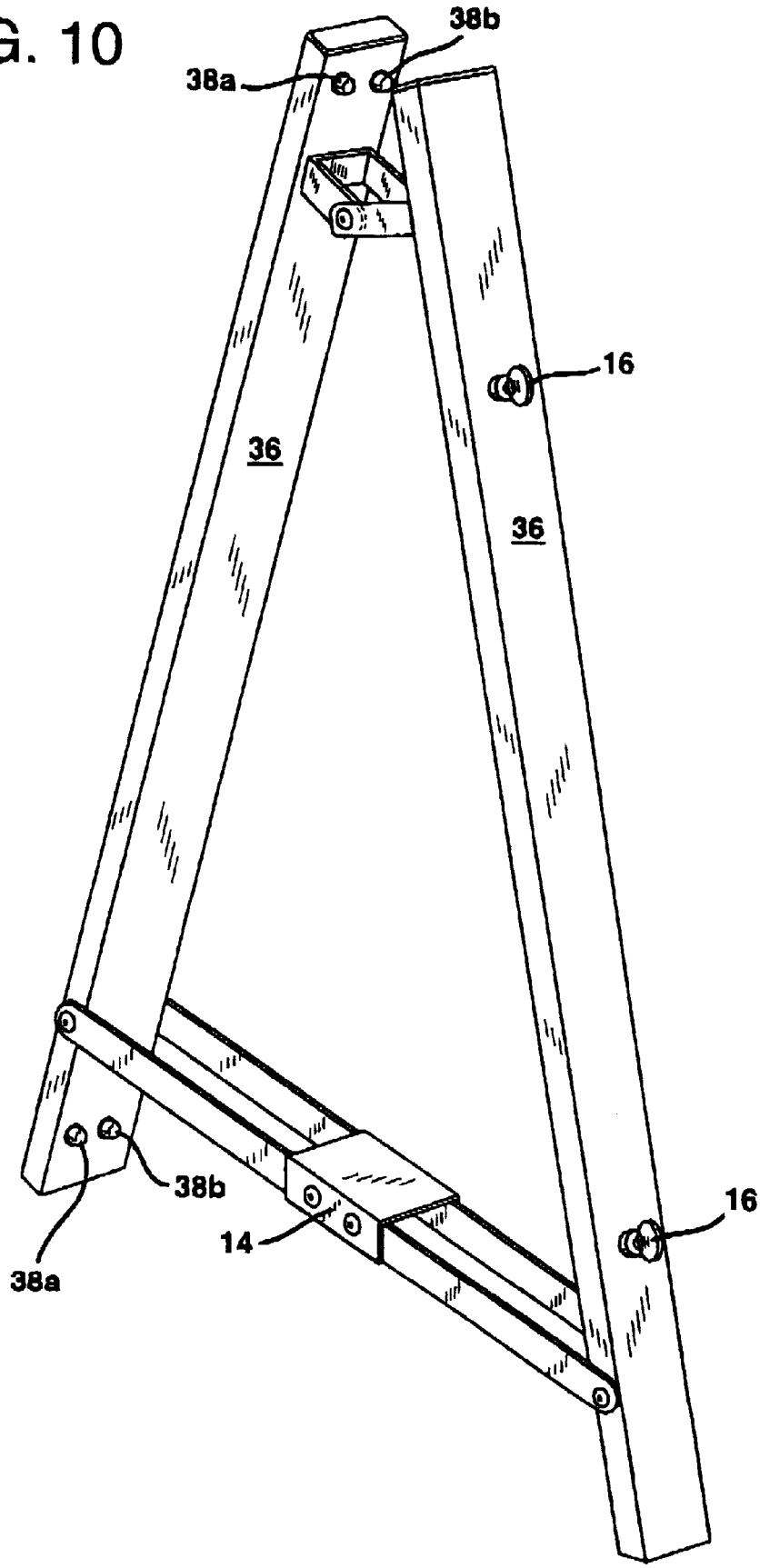
FIG. 10 is a perspective view of an embodiment of an A-frame support used in the sign support system of this invention.

Referring to FIGS. 7A and 7B, likewise, when the leg 36 is inserted in the bracket of an adjoining horizontal member the portion of the clip 38*b* protruding through the holes 42*b* of leg 36 interlocks with a mating hole 46 in the bracket attached to adjoining channel. As shown, for example in FIG. 3, both the top and bottom of each leg 36 of each A-frame 22 has such clip arrangement. Such an arrangement makes it simple and convenient to snap the end of each channel 24, 26, 28 and 30 into engagement with the end of leg 36 of each A-frame 22. Thus, the opposing ends of the channels are preferably slidably and removably and preferably lockably mounted to the ends of the support legs.

Referring to FIGS. 1 and 2, in its preferred embodiment, the sign support system 10 can be modularly extended horizontally to provide any desired length. For example, the system 10 of this invention may further comprise a third substantially vertically disposed end support structure 20 substantially parallel to the first and second end support structures 20. This third support structure 20 comprises two substantially vertically disposed support legs 36, each leg 36 having an upper 50 and a lower end 52. The upper ends of the legs 50 connect to each other by an upper connecting member 12 that can be extended or collapsed and the lower ends 52 connected to each other by a lower connecting member 14 that can be extended or collapsed. When the upper and lower connecting members 12, 14 are both extended the support structure forms an A-Frame type support structure, and when the upper and lower connecting members 12, 14 are both collapsed, the support legs are in close proximity and parallel to each other. Additionally, as with the other modular unit, a third pair of parallel upper channel members 28, 30 are provided. The members 28, 30 have opposing ends 28*a*, 28*b*, 30*a*, 30*b*, each having a channel therein 32, the opposing ends 28*a*, 28*b*, 30*a*, 30*b* of the channel members 28, 30 being connected to and removably mounted to the upper ends 50 of the support legs 36 of the third end support 20 structure to connect the third support end structure 20 to first or second end support structure 20 to each other when the upper and lower connecting members 28, 30 are extended.

As with the other units, a fourth pair of parallel lower channel members 24, 26 are also provided. These have opposing ends 24*a*,24*b*, 26*a*, 26*b* each having a channel 32 therein. The opposing ends 24*a*,24*b*, 26*a*, 26*b* of the channel members 24,26 connect and are removably mounted to the lower ends 52 of the support legs 36 of the third support structure 36 to connect the third support structure 36 to the first or second end support structure to each other when the upper and lower connecting members 12, 14 are extended.

Similar to the other modules, the channels 32 in the upper channel members 28, 30 have a downwardly opening channel 32 and the channels in the lower channel members 24, 26 of the third have an upwardly opening channel 32 for sliding a lower sign panel 40 therebetween.

Figure 11:
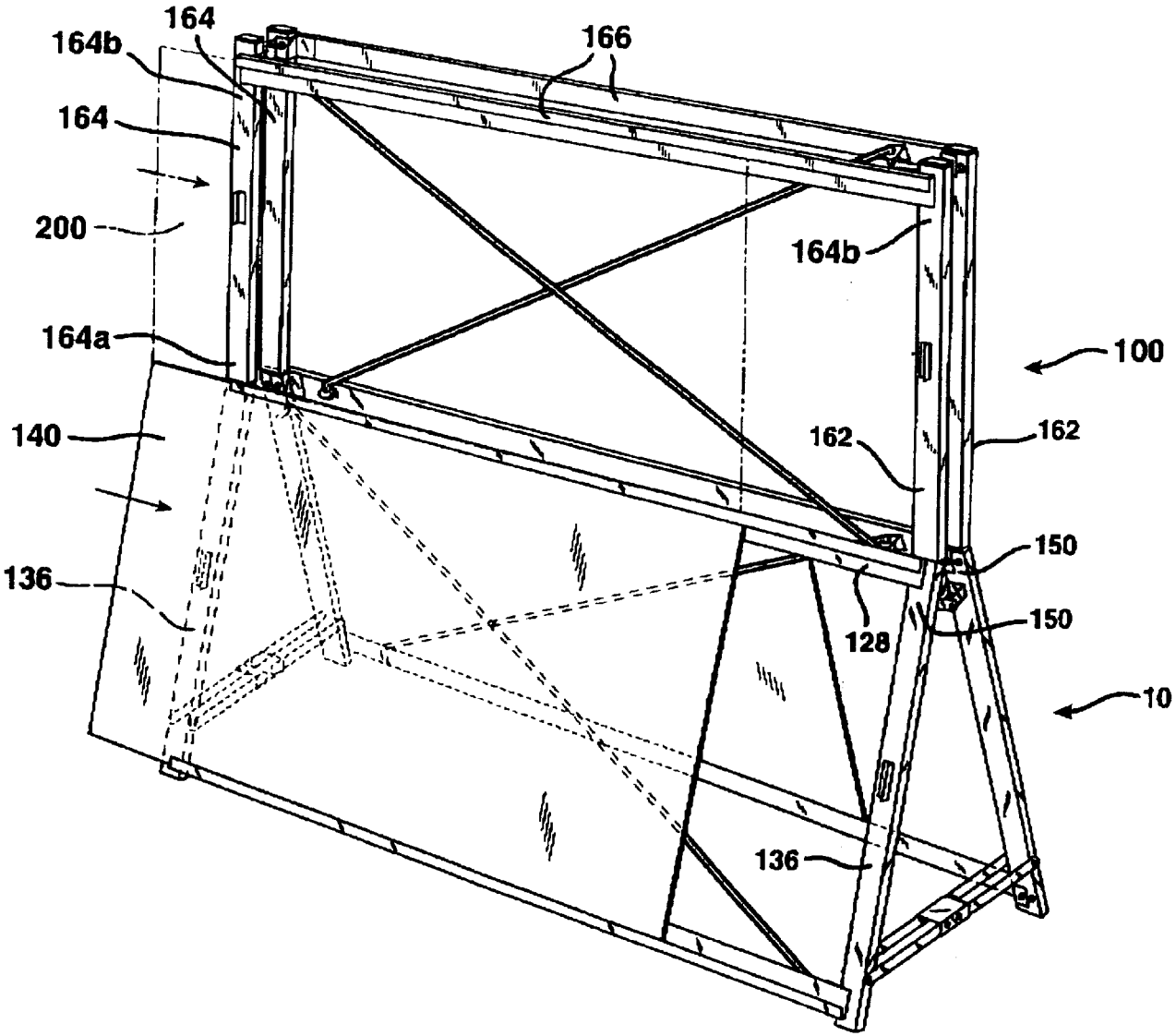
FIG. 11 is a perspective view of an embodiment of an assembled vertical multi-unit sign support system with a sign being placed therein.
Figure 12:
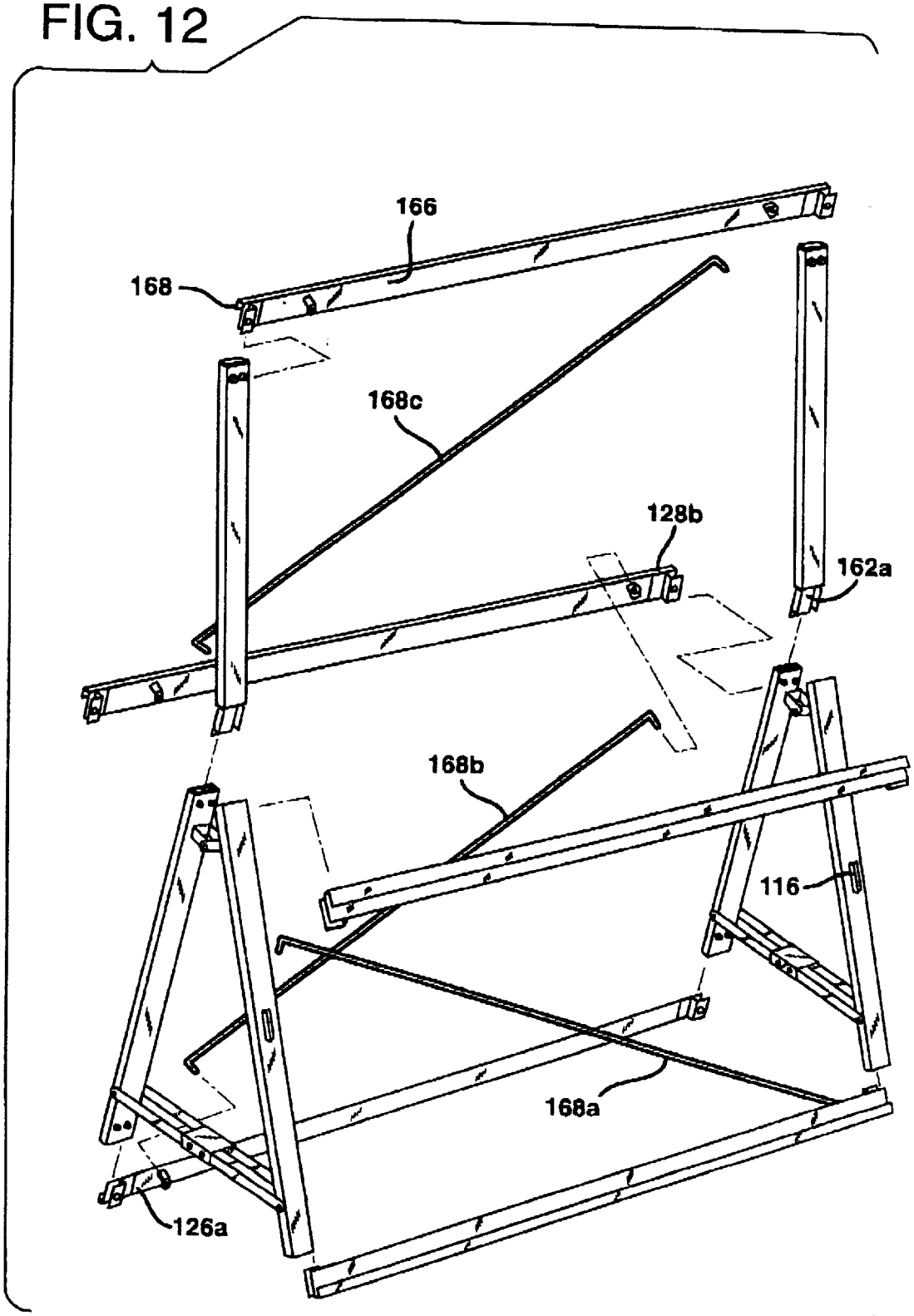
FIG. 12 is an exploded perspective view of an embodiment of a vertical multi-unit sign support system schematically depicting how it is assembled.

Referring to FIGS. 11–12, the base or lower module 10 of the sign support system of this invention, may further include an upper module structure 100. The upper module structure 100 comprises first and second substantially vertically disposed and parallel end support members 162, 164. Each end support member 162, 164 has a lower end and an upper end 162*a*, 162*b*, 164*a*, 164*b*. The lower end 162*a* of the first support member 162 being removably mounted to the upper end 150 of the vertically disposed support leg 136 of the first end support structure 120. Likewise, the lower end 164*a* of second support member 164 is removably mounted to the upper end 150 of the vertically disposed support leg 136 of the second end support structure 120.

Still referring to FIGS. 11–12, a top channel member 166 is provided. This member has opposing ends 166*a*, 166*b* and a downwardly opening channel 168. The opposing ends 166*a*, 166*b* of the top channel member 166 is connected to and removably mounted to the upper ends 162*a*, 164*b* of the first and second end support members 162, 164 to connect the first and second end support members 162, 164 to each other. An upper sign panel 200 is provided, of a size, shape and thickness suitable for removably mounting between the top channel 166 and the opposing upper channel member 128 in the downwardly opening channel 168.In the embodiment depicted in FIGS. 1–12, the upper sign panel 200 is kept in place at its upper end by the downwardly opening channel 168 and at its lower end by resting on the top of upper channel member 128. Optionally, upper channel member 128 could have two channels therein, the lower channel 132 to keep the lower sign panel 140 in place and an upper channel (not shown) to keep the upper sign panel in place.

Figure 13:
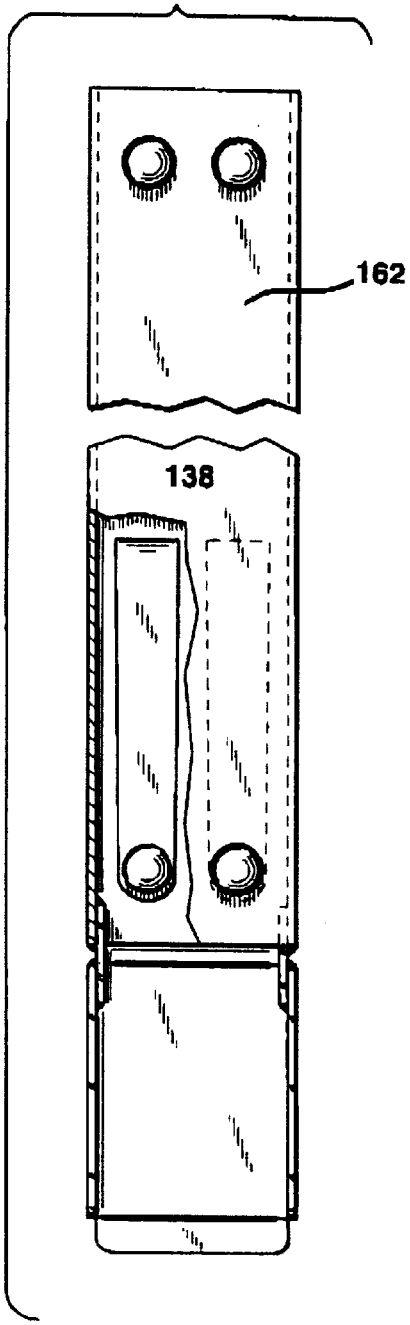
FIG. 13 is a fragmentary front view depicting an embodiment of the assembly of the elements required for vertically mounting a sign support unit on the top of an A-frame leg.
Figure 14:
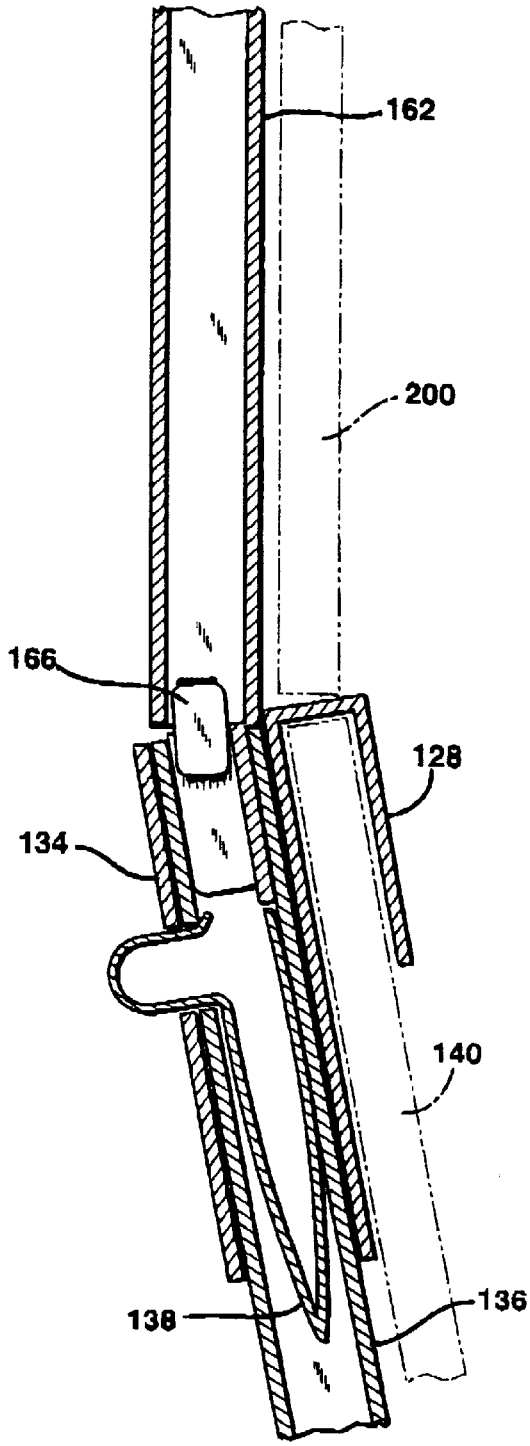
FIG. 14 is a cross-sectional view of the embodiment of the assembly of the elements depicted in FIG. 13 required for vertically mounting a sign support unit on the top of an A-frame leg.

FIGS. 13 and 14 depict one embodiment for mounting the upper module 100 onto the lower module 10. FIG. 13 is a fragmentary front view and FIG. 14 is a cross-sectional view depicting the assembly of the elements, e.g., vertical support member 162 and A-frame leg 136, required for vertically mounting the top sign support unit 200.

More specifically, referring to FIGS. 13 and 14, upper channel members 128 includes a channel or fluting 132 therein which is of a size that permits the sign panel 140 to slide therethrough and to removably hold the sign 140 in position. Each end of the channel 128*a* has a bracket 134 mounted thereon. The bracket 134 is of a size and shape that permits the upper end 150 of leg 136 of the A-frame to slip into the bracket 134. A means is provided for locking the A-Frame leg 136 in the bracket 134. In a manner similar to that shown in FIGS. 5A, B and C, spring clip 138*a* is inserted into a formed hollow 144 in leg 136. When the A-frame leg 136 is inserted in the bracket 134 the portion of the spring clip 138*a* protruding through the holes 142*a* of leg 136 interlocks with a mating hole 146 in the bracket 134. Vertical support member 162, has an end 162*a* that slidably mates into hollow 144 of member 136 for support and to maintain the clip 138*a* in place.

Preferably, in all of these embodiments, the ends of the channels are open so that the sign panels 40, 140,200 are removably and slidably mounted between opposing lower and upper channel members in the opposing downwardly and upwardly opening channels.

Several other specific features should be noted. Referring to FIGS. 1–3, 6A, and6B, each A-frame leg 36 has two (2) removable thumb screws 16 thereon. These screws 16 are used to prevent the sign 40 from sliding out or being easily removed by unauthorized people and can be screwed in and out of the leg 36. In a similar manner, referring to FIG. 12 the legs 136 may have angled stops 116 welded or screwed thereon to prevent the sign 140 from sliding out or being easily removed by unauthorized people.

Referring to FIG. 12, in order to assist in stabilizing and supporting the upper and lower modules 10, 100 struts 168*a*, 168*b* and 168*c* may used to connect one end of a lower channel member, e.g., 126*a* with the diagonally opposed upper channel member, e.g., 128*b*. The struts may be locked in place through holes 170 in the rear of the channel member 126, 128, 166 so as not to interfere with the signs 140, 200.

As depicted, the modules 10 may be used as a free standing single unit or as depicted herein used as interlocking multiple units that attach together to provide an unlimited modular length. Additionally, the use of modular unit 100 permits the height of signage to be increased in a modular manner.

Once the unit is assembled, the sign panels 40, 140, 200 are slid into position, the channels maintaining them securely. Typically, each sign panel is three feet high by six feet long, although other size panels may be used. The channel or fluting size preferred permits up to a ¼" thick sign to slide there through and be held in place.

Preferably the sign system of this invention is a metal structure, however all or various parts of the system may be made of a polymer, i.e., plastic.

There are numerous benefits to the sign support system of this invention. There are only four points of contact to the ground's surface for each lower module 10, the lower channel members 126 being elevated from the ground, e.g., about ½ inch. This makes the system very stable, particularly on terrain that may not be flat. Additionally, the system is very stable under windy conditions. The reason for this is because the width of the A-frame base that touches the ground is very broad, e.g., 25 inches and the top is narrow, e.g., 5 inches wide. This provides a low center of gravity for the unit, particularly when there is no upper module 100.

The unit 20 is comprised of six (6) pieces, i.e., two "A-frames" and four(4) "channel members" that can be snapped together very quickly, e.g., less than one minute.

In summary, the sign support system of this invention is used to secure signs to an associated stable base fixture which is easily assembled, and disassembled and when disassembled is relatively portable. The system may be used at sporting events, track meets, marathons, etc. and after use, disassembled and transported and used at another event.

The sign system of this invention is easy to disassemble at one venue, pack, ship, unpack and reassemble in a another venue. The sign support system may be assembled to provide an almost unlimited length of signage by horizontally connecting a plurality of sign support units. It may also provide flexibility in the height of signage by vertically connecting a plurality of units.

It will be understood that various changes in the details, arrangements and configuration of the parts and assemblies which have been described and illustrated may be made by those skilled in the art within the principle and scope of the present invention.

What is claimed is:

1. A sign support system comprising:

a plurality of substantially vertically disposed end support structures, the support structures being substantially parallel to each other, each support structure comprising two substantially vertically disposed support legs each leg having an upper and a lower end, the upper ends connected to each other by an upper connecting member that can be extended or collapsed and the lower ends connected to each other by a lower connecting member that can be extended or collapsed, wherein when the upper and lower connecting members are both extended the support structure forms a frame support structure, and when the upper and lower connecting members are both collapsed, the support legs are in close proximity and parallel to each other;

a first pair of upper channel members having opposing ends, each having a channel therein, the opposing ends of the channel member connecting and removably mounted to the upper ends of the support legs to connect the first and second end support structures to each other when the upper and lower connecting members are extended;

a second pair of lower channel members having opposing ends, each having a channel therein, the opposing ends of the channel member connecting and removably mounted to the lower ends of the support legs to connect the first and second end support structures to each other when the upper and lower connecting members are extended;

wherein the opposing ends of the channels are slidably, removably and lockably mounted to the ends of the support legs;

wherein the channels in the upper channel members have a downwardly opening channel and the channels in the lower channel members have an upwardly opening channel; and at least one lower sign panel of a size, shape and thickness suitable for removably mounting between opposing lower and upper channel members in the opposing downwardly and upwardly opening channels.

2. A sign support system comprising:

a first and a second substantially vertically disposed end support structure, the support structures being substantially parallel to each other, each support structure comprising two substantially vertically disposed support legs each leg having an upper and a lower end, the upper ends connected to each other by an upper connecting member that can be extended or collapsed and the lower ends connected to each other by a lower connecting member that can be extended or collapsed, wherein when the upper and lower connecting members are both extended the support structure forms an A-Frame type support structure, and when the upper and lower connecting members are both collapsed, the support legs are in close proximity and parallel to each other;

a first pair of parallel upper channel members having opposing ends, each having a channel therein, the opposing ends of the channel member connecting and removably mounted to the upper ends of the support legs to connect the first and second end support structures to each other when the upper and lower connecting members are extended;

a second pair of parallel lower channel members having opposing ends, each having a channel therein, the opposing ends of the channel member connecting and removably mounted to the lower ends of the support legs to connect the first and second end support structures to each other when the upper and lower connecting members are extended;

wherein the opposing ends of the channels are slidably, removably and lockably mounted to the ends of the support legs;

wherein the channels in the upper channel members have a downwardly opening channel and the channels in the lower channel members have an upwardly opening channel; and at least one lower sign panel of a size, shape and thickness suitable for removably mounting between opposing lower and upper channel members in the opposing downwardly and upwardly opening channels.

3. The sign support system of claim 2, wherein the ends of the channels are open and the lower sign panel is removably and slidably mounted between opposing lower and upper channel members in the opposing downwardly and upwardly opening channels.

4. A sign support system comprising:

a first and a second substantially vertically disposed end support structure, the support structures being substantially parallel to each other, each support structure comprising two substantially vertically disposed support legs each leg having an upper and a lower end, the upper ends connected to each other by an upper connecting member that can be extended or collapsed and the lower ends connected to each other by a lower connecting member that can be extended or collapsed, wherein when the upper and lower connecting members are both extended the support structure forms an A-Frame type support structure, and when the upper and lower connecting members are both collapsed, the support legs are in close proximity and parallel to each other;

a first pair of parallel upper channel members having opposing ends, each having a channel therein, the opposing ends of the channel member connecting and removably mounted to the upper ends of the support legs to connect the first and second end support structures to each other when the upper and lower connecting members are extended;

a second pair of parallel lower channel members having opposing ends, each having a channel therein, the opposing ends of the channel member connecting and removably mounted to the lower ends of the support legs to connect the first and second end support structures to each other when the upper and lower connecting members are extended;

wherein the channels in the upper channel members have a downwardly opening channel and the channels in the lower channel members have an upwardly opening channel;

at least one lower sign panel of a size, shape and thickness suitable for removably mounting between opposing lower and upper channel members in the opposing downwardly and upwardly opening channels;

a third substantially vertically disposed end support structure substantially parallel to the first and second end support structures, the third support structure comprising two substantially vertically disposed support legs each leg having an upper and a lower end, the upper ends connected to each other by an upper connecting member that can be extended or collapsed and the lower ends connected to each other by a lower connecting member that can be extended or collapsed, wherein when the upper and lower connecting members are both extended the support structure forms an A-Frame type support structure, and when the upper and lower connecting members are both collapsed, the support legs are in close proximity and parallel to each other;

a third pair of parallel upper channel members having opposing ends, each having a channel therein, the opposing ends of the channel connecting and removably mounted to the upper ends of the support legs of the third end support structure to connect the third support end structure to first or second end support structure to each other when the upper and lower connecting members are extended;

a fourth pair of parallel lower channel members having opposing ends, each having a channel therein, the opposing ends of the channel connecting and removably mounted to the lower ends of the support legs of the third support structure to connect the third support structure to the first or second end support structure to each other when the upper and lower connecting members are extended;

wherein the channels in the upper channel members of the third end support structure have a downwardly opening channel and the channels in the lower channel members of the third end support structure have an upwardly opening channel; and at least one other lower sign panel of a size, shape and thickness suitable for removably mounting between opposing lower and upper channel members of the third end support structure in the opposing downwardly and upwardly opening channels.

5. The sign support system of claim 4, further comprising first and second substantially vertically disposed and parallel end support members, each end support member having a lower end and an upper end, the lower end of the first support member being removably mounted to the upper end of the vertically disposed support leg of the first end support structure and the lower end of second support member being removably mounted to the upper end of the vertically disposed support leg of the second end support structure;

a top channel member having opposing ends and a downwardly opening channel, the opposing ends of the top channel member connecting and removably mounted to the upper ends of the first and second end support members to connect the first and second end support members to each other;

an upper sign panel of a size, shape and thickness suitable for removably mounting between the top channel and the opposing upper channel member in the downwardly opening channel.

6. The sign support system of claim 5, wherein the ends of the channels are open and the lower sign panels are removably and slidably mounted between opposing lower and upper channel members in the opposing downwardly and upwardly opening channels and the upper sign panel is removably and slidably mounted in the downwardly opening channel between the opposing top channel member and upper channel.

7. The sign support system of claim 5, wherein the opposing ends of the channels are slidably and removably mounted to the ends of the support legs and the lower ends of the support members are slidably and removably mounted to the upper ends of the support legs.

8. The sign support system of claim 5, wherein the opposing ends of the channels are slidably, removably and lockably mounted to the ends of the support legs and the lower ends of the support members are slidably, removably and lockably mounted to the upper ends of the support legs.

9. The sign support system of claim 4, wherein the ends of the channels are open and the lower sign panels are removably and slidably mounted between opposing lower and upper channel members in the opposing downwardly and upwardly opening channels.

10. The sign support system of claim 4, wherein the opposing ends of the channels are slidably and removably mounted to the ends of the support legs.

11. The sign support system of claim 4, wherein the opposing ends of the channels are slidably, removably and lockably mounted to the ends of the support legs.

* * * * *